US008159453B2

(12) United States Patent
Matsui

(10) Patent No.: US 8,159,453 B2
(45) Date of Patent: Apr. 17, 2012

(54) DISPLAY DEVICE AND METHOD FOR CONTROLLING BACKLIGHT THEREOF

(75) Inventor: Yoshikazu Matsui, Kobe (JP)

(73) Assignee: Chimei Innolux Corporation, Chu-Nan (TW)

( * ) Notice: Subject to any disclaimer, the term of this patent is extended or adjusted under 35 U.S.C. 154(b) by 522 days.

(21) Appl. No.: 12/463,958

(22) Filed: May 11, 2009

(65) Prior Publication Data

US 2009/0289948 A1 Nov. 26, 2009

(30) Foreign Application Priority Data

May 12, 2008 (JP) ..... 2008-125039

(51) Int. Cl.
*G09G 3/36* (2006.01)

(52) U.S. Cl. ..... 345/102; 362/97.1; 362/97.2

(58) Field of Classification Search ..... 362/97.1–97.3, 362/276, 802; 345/102, 558
See application file for complete search history.

(56) References Cited

U.S. PATENT DOCUMENTS

| | | | | |
|---|---|---|---|---|
| 4,408,880 | A * | 10/1983 | Tsuji et al. | 356/338 |
| 4,696,573 | A * | 9/1987 | Hutchin | 356/521 |
| 6,025,778 | A * | 2/2000 | Dietz et al. | 340/463 |
| 6,307,331 | B1 * | 10/2001 | Bonasia et al. | 315/294 |
| 6,812,649 | B2 * | 11/2004 | Kim | 315/149 |
| 7,111,952 | B2 * | 9/2006 | Veskovic | 362/1 |
| 7,236,154 | B1 * | 6/2007 | Kerr et al. | 345/102 |
| 2007/0183163 | A1 * | 8/2007 | Daniel | 362/489 |
| 2008/0231464 | A1 * | 9/2008 | Lewis et al. | 340/825 |

* cited by examiner

*Primary Examiner* — Alexander Eisen
*Assistant Examiner* — Sanjiv D Patel
(74) *Attorney, Agent, or Firm* — Liu & Liu

(57) ABSTRACT

A display device having backlight and the backlight control method thereof is provided. Through the provided method, it is capable of fast determining which intensity range the intensity signal from the means for measuring the intensity of external light falls in, so that the turn-off period of backlight is reduced to avoid the decrement of brightness.

9 Claims, 6 Drawing Sheets

DISPLAY DEVICE AND METHOD FOR CONTROLLING BACKLIGHT THEREOF

BACKGROUND OF THE INVENTION

1. Field of the Invention

The present invention relates to a display device and a method for controlling the backlight thereof.

2. Description of the Prior Art

Generally, a display device, especially a liquid crystal display (LCD) apparatus, is provided with a backlight device functioning as a light emitting device to provide images sufficient brightness such that the visibility of the display device can be enhanced under dim lighting conditions. Furthermore, relevant techniques have been developed to control the illuminance of the backlight device based on the ambient lighting condition, thereby the visibility of the LCD apparatus can be improved, allowing devices having LCD apparatus, such as mobile phones, cameras and personal digital assistances (PDAs), to be used under a wide range of lighting conditions.

The Japanese Patent Published No. 2005-24796 discloses a backlight constructed as a multilayer structure. In this case, the backlight is controlled by detecting brightness of surroundings of the liquid crystal display device with a photosensor.

The range of brightness of the detected external light may be quite wide (e.g. in a range from 10 to 10000 lux), thus it is impossible to cover the entire range of light intensity with an output level only. Therefore, the photosensor must switch among a plurality of sensitivity ranges to output the most appropriate signal range so as to obtain the signals.

FIG. 1 is a schematic view showing the structure of a conventional LCD apparatus that utilizes the output of a photosensor to control the backlight thereof according to the prior art. The backlight device 1 is disposed at the bottom of the structure, and the photosensor 11 is disposed on a glass substrate 10 of the LCD panel to generate corresponding light intensity signals based on the detected light intensity. The selection and measurement device for sensitivity range 12 is constructed by four standard switches SW1-SW4 to select the light intensity among the four sensitivity ranges so as to output the most appropriate sensitivity range. In order to select a most appropriate sensitivity range, the switches have to operate to perform the switching among various sensitivity ranges as follows, so as to determine within which sensitivity range the current signal falls.

The control device 20 is configured to access the outputted sensitivity range and to control the illuminance of the backlight based thereon.

When the backlight is turned on, the photosensor will check the light intensity and thus fail to accurately measure the intensity of the external light. In this case, the backlight has to be turned off to accurately measure the external light.

FIG. 2 is a flowchart showing the process of selecting the most appropriate sensitivity range according to the prior art. In such process, four sensitivity ranges of different levels A, B, C and D are used to cover the entire sensitivity range of the external light, so as to determine that the level of the external light falls within which sensitivity range at the time when each image shot (approximately 16 milliseconds) starts to be displayed.

In Step S1, the backlight is firstly turned off. As the sensitivity range A is selected, the switch SW1 is turned on and the data are being accessed. In order to access the data unaffected by the backlight, the backlight must be turned off for a period of time, e.g. 500 microseconds. Then, the process proceeds to Step S2 where the control device determines whether the accessed data fall within the sensitivity range A. If the determination in Step S2 is negative, the process proceeds to Step S3 where the backlight remains off, the switch SW2 is turned on, and the data are being accessed. After that, the process proceeds to Step S4 where a determination is made as to whether the accessed data fall within the sensitivity range B. The sensitivity ranges C and D will be selected sequentially and similar steps will be repeated so as to obtain correct data on the sensitivity range (Steps S5~S8). If the control device determines that the data fall within one of the four sensitivities ranges, correct data will be obtained, and then the backlight will be turned on (Step S10). Meanwhile, if the control device is unable to determine which sensitivity range the data fall within, error data will be obtained, but still the backlight will be turned on (Step S9). The aforementioned steps are repeated after a duration of image phase passes (Step S11).

As the conventional LCD apparatus adopts four sensitivity ranges, the backlight will be turned off for 500×4=2000 microseconds during each image shot until the most appropriate data are obtained. Even if the most appropriate sensitivity range is obtained and the process of determining whether the data fall within the rest of sensitivity ranges stops, the average turn-off period of the backlight still lasts more than 1000 microseconds.

As it takes longer time to determine which sensitivity range the data fall within in the prior art, the backlight needs to be turned off for a long period of time. This results in a decrement in the luminescent efficiency of the backlight and the brightness of the image.

SUMMARY OF THE INVENTION

It is an object of the present invention to provide a display device and a method for controlling the backlight thereof. The method is capable of promptly determining within which intensity range the light intensity signal outputted from the selection and measurement device the intensity of the external light falls, so that the turn-off period of the backlight can be reduced to prevent the brightness thereof from decreasing.

According to a first aspect of the present invention, a display device is provided, which includes a display panel; a backlight device disposed under the display panel wherein the illuminance of the backlight device is adjustable; a selection and measurement device for light intensity which is configured to measure the ambient light intensity of the display panel at a prescribed frequency when light intensity signals of a sensitivity range selected from a plurality of prescribed sensitivity ranges are outputted; and a control device determining whether a latest prescribed light intensity signal falls within a upper portion, a lower portion of a remaining portion of one of the plurality of prescribed sensitivity ranges. The control device includes a memory device for sequentially memorizing the light intensity signals; a first average device obtaining a first average value of a first prescribed number of light intensity signals read out from the memory device; a second average device for obtaining a second average value of a second prescribed number of light intensity signals read out from the memory device, wherein the second prescribed number is larger than the first prescribed number; and a calculation and control device.

The calculating is performed with the selection and measurement device and accordingly controlling the illuminance of the backlight device. When the control device determines that all of the first prescribed number of light intensity signals fall within the upper portion and the first average value is greater than the second average value, the calculating is performed based upon the sensitivity range adjacent to said upper portion of said prescribed sensitivity range. When the control device determines that all of the first prescribed number of light intensity signals fall within the lower portion and the first average value is smaller than the second average value, the calculating is performed based upon the sensitivity range adjacent to the lower portion of the sensitivity range. Moreover, the calculating is performed based upon the sensitivity range when the control device determines that all of the first prescribed number of light intensity signals fall within neither the upper portion nor the lower portion.

Furthermore, in accordance with a second aspect of the present invention, a backlight control method for a display device is provided. The method includes steps of measuring the ambient light intensity of a display panel with a prescribed cycle; outputting light intensity signals of a sensitivity range selected from a plurality of prescribed sensitivity ranges; memorizing the light intensity signals sequentially; determining whether a latest light intensity signal falls within a upper portion, a lower portion or a remaining portion of one of the plurality of prescribed sensitivity ranges; obtaining a first average value of a first prescribed number of the memorized light intensity signals; obtaining a second average value of a second prescribed number of the memorized light intensity signals, wherein the second prescribed number is larger than said first prescribed number; and calculating and accordingly controlling the illuminance of a Illuminance-adjustable backlight device disposed under the display panel, wherein when the control device determines that all of the first prescribed number of light intensity signals fall within the upper portion and the first average value is greater than the second average value, the calculating is performed based upon the sensitivity range adjacent to said upper portion of said prescribed sensitivity range. When the control device determines that all of the first prescribed number of light intensity signals fall within the lower portion and the first average value is smaller than the second average value, the calculating is performed based upon the sensitivity range adjacent to the lower portion of the sensitivity range. Moreover, the calculating is performed based upon the sensitivity range when the control device determines that all of the first prescribed number of light intensity signals fall within neither the upper portion nor the lower portion.

The display device of the present invention is capable of controlling the illuminance of the backlight thereof corresponding to the ambient lighting condition and reducing the turn-off period required for measuring the external light, thereby to maintain sufficient brightness and good visibility.

DETAILED DESCRIPTION OF THE PREFERRED EMBODIMENTS

The present invention will be described more fully hereinafter with reference to the accompanying drawings, in which preferred embodiments of the invention are shown. It is to be noted that this invention may, however, be embodied in many different forms and should not be construed as limitations to the embodiments set forth herein.

Figure 3:
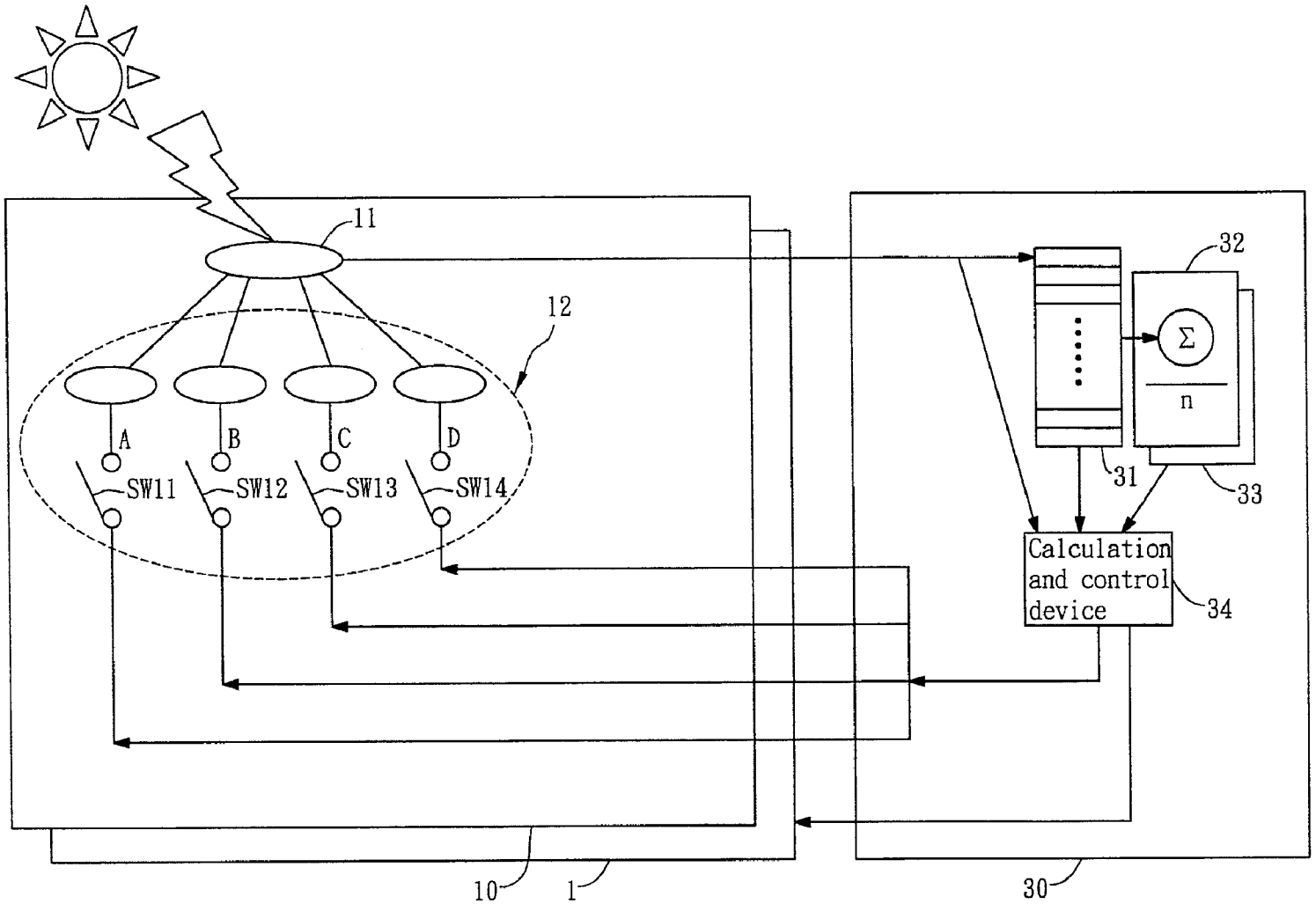
FIG. 3 is a schematic view showing the structure of a display device and the intensity determination steps according to a first embodiment of the present invention.

FIG. 3 is a schematic view showing the structure of a display device and the intensity determination steps according to a first embodiment of the present invention. In this embodiment, the display device is an LCD apparatus with backlight. The components the same as those illustrated in FIG. 1 are provided with the same reference numerals and are not repeated for clarity.

Figure 1:
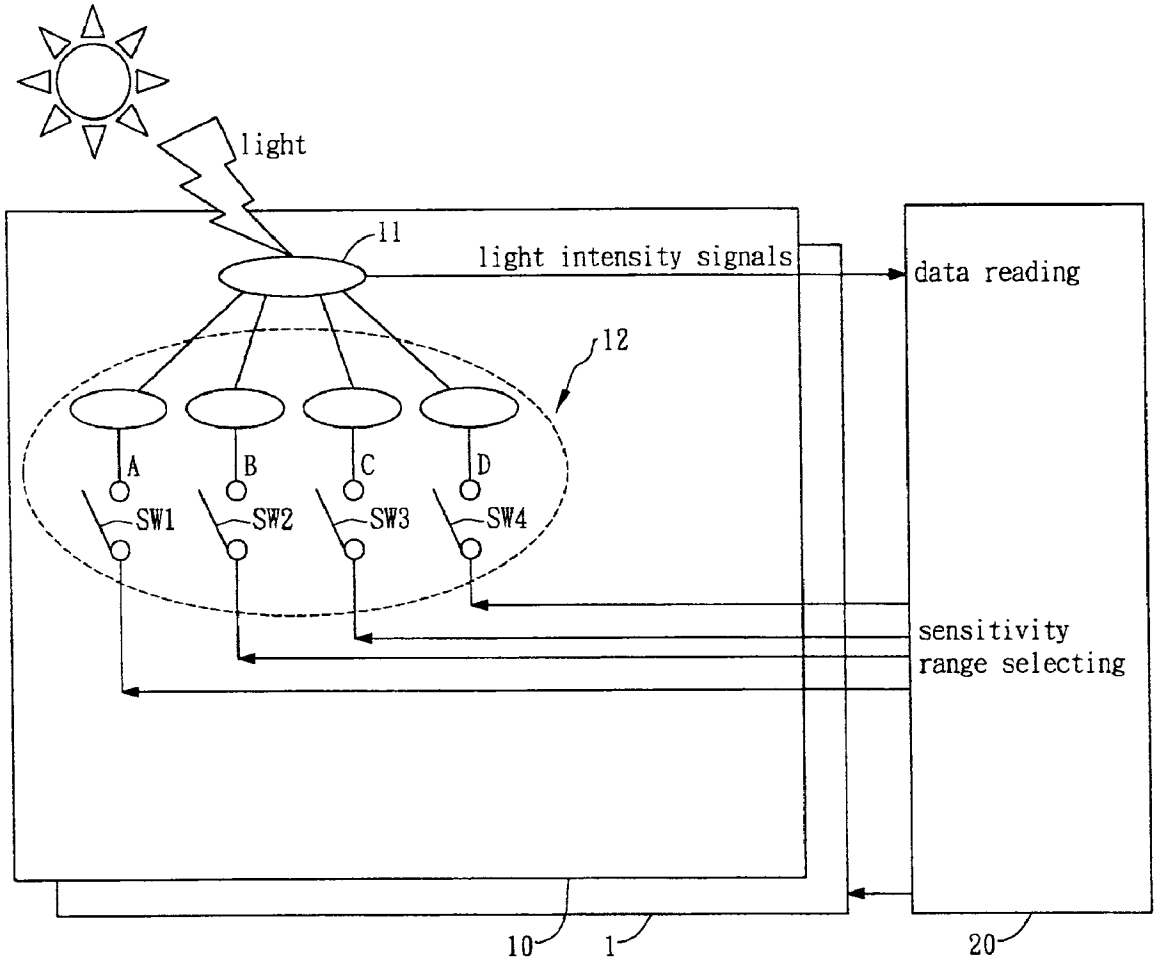
Fig. 1 (Prior Art)
FIG. 1 is a schematic view showing the structure of a conventional LCD apparatus with backlight according to the prior art.
Figure 2:
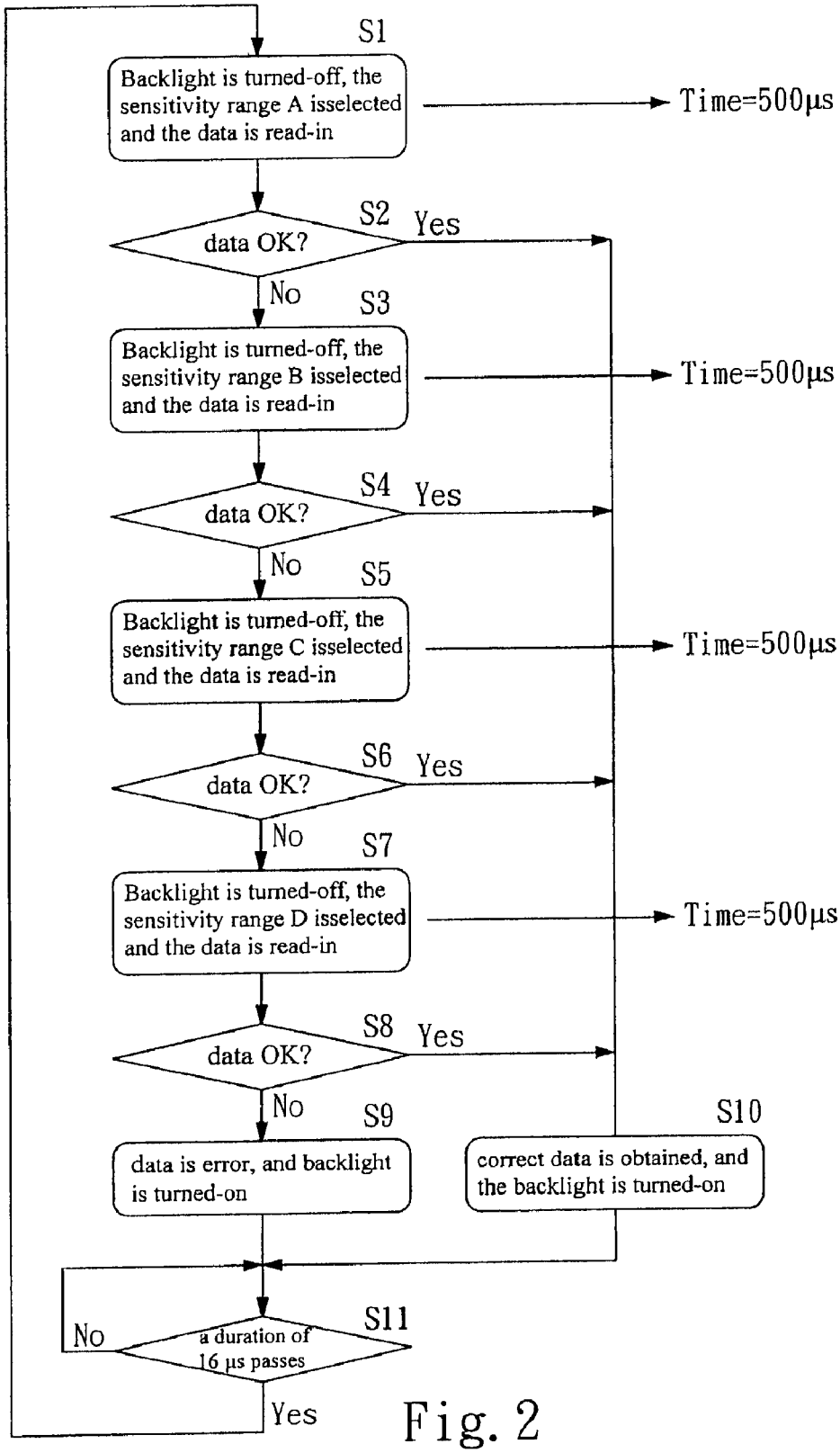
Fig. 2 (Prior Art)
FIG. 2 is a flowchart showing the details of steps of determining the sensitivity range as illustrated in FIG. 1.

The LCD panels illustrated on the left side of FIGS. 1 and 3 are exactly the same, while the control devices 20 and 30, which are illustrated on the right side of FIGS. 1 and 3 respectively, are completely different in structure.

The light intensity signals from the photosensor 11, such as a photoelectric switch, are firstly sent to the control device 30 and then stored in a first-in-first-out (FIFO) memory 31. In some embodiment, the FIFO memory 31 can memorize approximately 100 data entries.

The three latest data entries memorized in the FIFO memory 31 are sent to a first average calculating unit 32 to produce an average data (short-time average value), and meanwhile the 60 latest data entries memorized in the FIFO memory 31 are sent to a second average calculating unit 33 to produce an average data (long-time average value).

Figure 4:
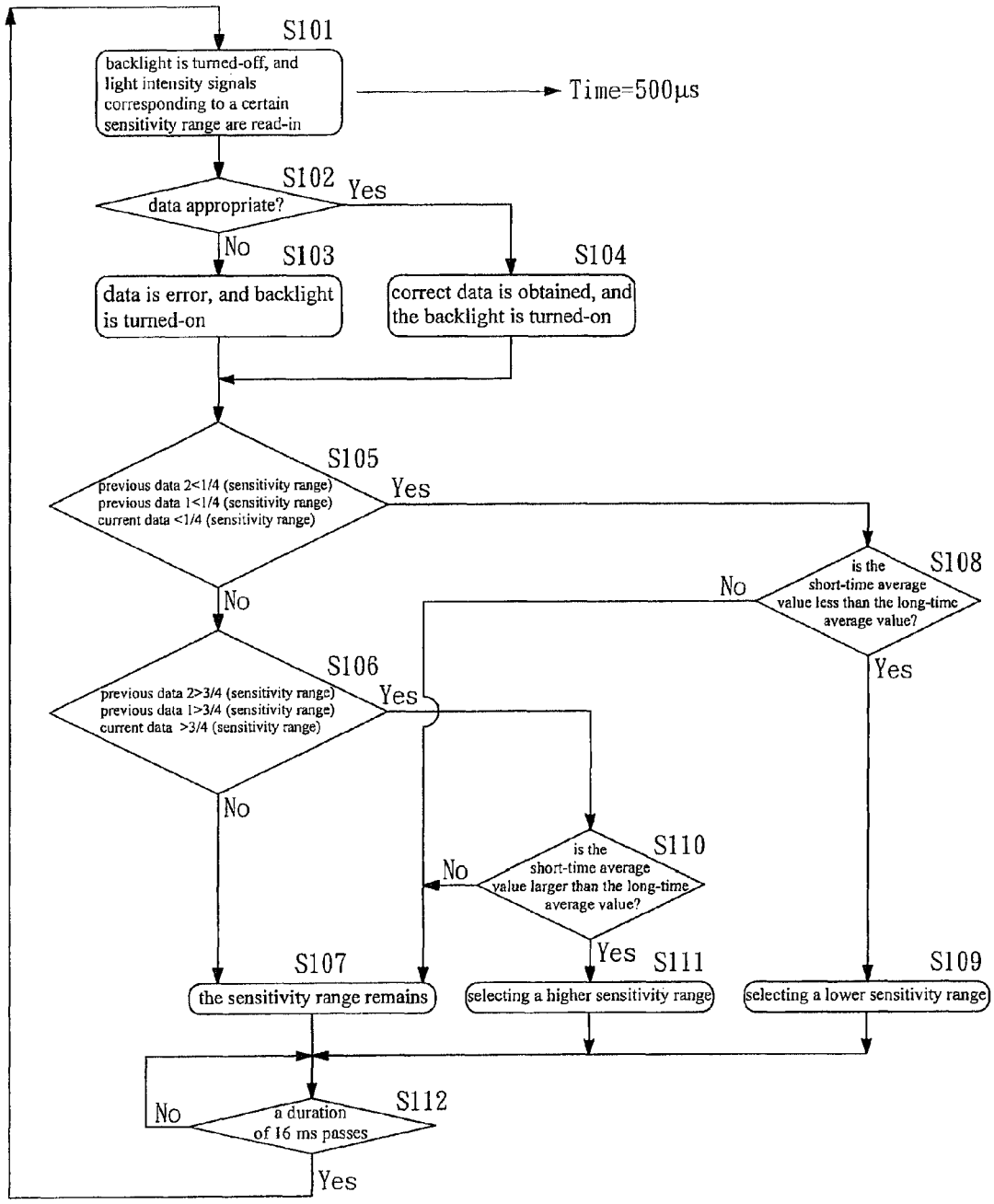
FIG. 4 is a flowchart showing the details of the intensity determination steps as illustrated in FIG. 3.

The calculation and control device 34 will execute the steps of the flowchart illustrated in FIG. 4.

In Step S101, the backlight is turned off when an image starts to be displayed, and the light intensity signals associated with a particular sensitivity range are being accessed. For example, FIG. 3 shows four sensitivity ranges A, B, C and D among which the lower sensitivity range B may be selected as the initial condition. It is to be noted that any one of the four sensitivity ranges may be selected at the initial stage.

Then, the process proceeds to Step S102 where the calculation and control device 34 determines whether the inputted light intensity data fall within the selected sensitivity range.

The backlight will be turned on (Steps S103 and S104) and remain on throughout the successive steps no matter the inputted data are identified as error data (Step S103) or correct data (Step S104).

Then, the current data, the data prior to an image (previous data 1) and the data prior to two images (previous data 2) will be examined to determine whether the three data entries fall within the upper portion, the middle portion or the lower portion of the sensitivity range. In this embodiment, the upper portion accounts for one fourth of the sensitivity range, so does the lower portion.

In Step S105, a determination is made as to whether the three data entries are less than one fourth of the sensitivity range, i.e. fall within the lower portion of the sensitivity range.

If the determination in Step S105 is negative, the process proceeds to Step S106 where a determination is made as to whether the three data entries are larger than three fourth of the sensitivity range, i.e. fall within the top portion.

If the three data entries do not fall within either the top portion or the lower portion, they will be deemed as falling within the middle portion of the sensitivity range and kept within the sensitivity range (Step S107).

If the determination in Step S105 is affirmative, the process proceeds to Step S108 where a determination is made as to whether the short-time average value produced by the first average calculating unit 32 is smaller than the long-time average value produced by the second average calculating unit 33. If the determination in Step S108 is affirmative, which indicates the value of the current data tends to decrease, the process proceeds to Step S109 where a lower sensitivity range is selected.

If the determination in Step S106 is affirmative, the process proceeds to Step S110 where a determination is made as to whether the short-time average value produced by the first average calculating unit 32 is greater than the long-time average value produced by the second average calculating unit 33. If the determination in Step S110 is affirmative, which indicates the value of the current data tends to increase, the process proceeds to Step S111 where a higher sensitivity range is selected. The switch SW12 will then be turned on based on the command issued by the calculation control device 34 illustrated in FIG. 3.

If the determinations in Steps S108 and S110 are both negative, the sensitivity range remains unchanged.

Figure 5:
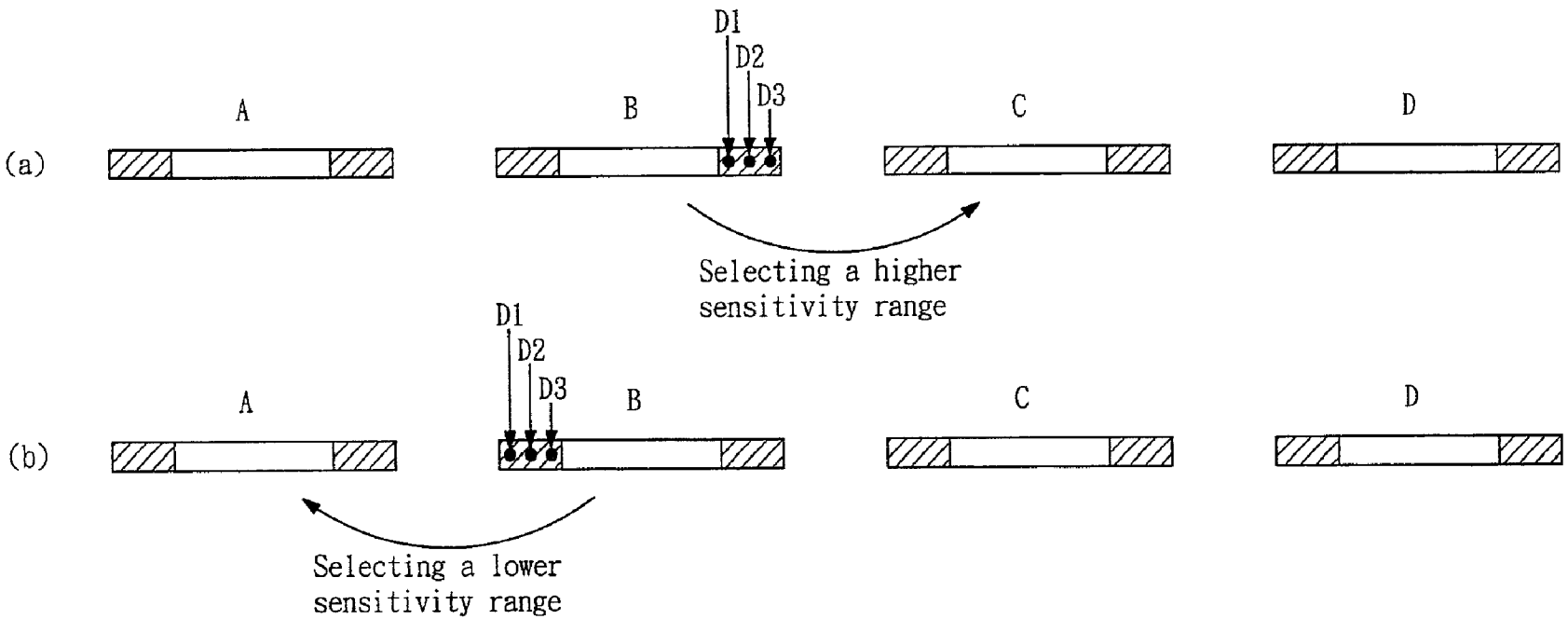
FIG. 5 is a visualized presentation showing the adjustment of the sensitivity range.

FIG. 5 is a visualized presentation showing the adjustment of the sensitivity range. Referring to FIG. 5*a*, there are four sensitivity ranges A, B, C and D. For example, the light intensity is measured three times in a cycle of 16 milliseconds to generate three measured values D1, D2 and D3. If the sensitivity range B is selected and all of the three measured values D1, D2 and D3 fall within the top one fourth of the sensitivity range B, it fulfills the conditions that the determinations in Steps S106 and S110 are both affirmative. Consequently, a higher sensitivity range (the sensitivity range C) is selected.

Referring to FIG. 5*b*, all of the three measured values D1, D2 and D3 fall within the bottom one fourth of the sensitivity range B, thus it fulfills the conditions that the determinations in Steps S105 and S108 are both affirmative. Consequently, a lower sensitivity range (the sensitivity range A) is selected.

When the sensitivity range of the external light is obtained, the calculation and control device 34 can easily adjust the illuminance of the backlight device correspondingly.

All the aforementioned steps are executed during an image phase (16 milliseconds). When the backlight is turned off for 500 microseconds, an appropriate sensitivity range can be selected so as to have the backlight provide sufficient illuminance.

Figure 6:
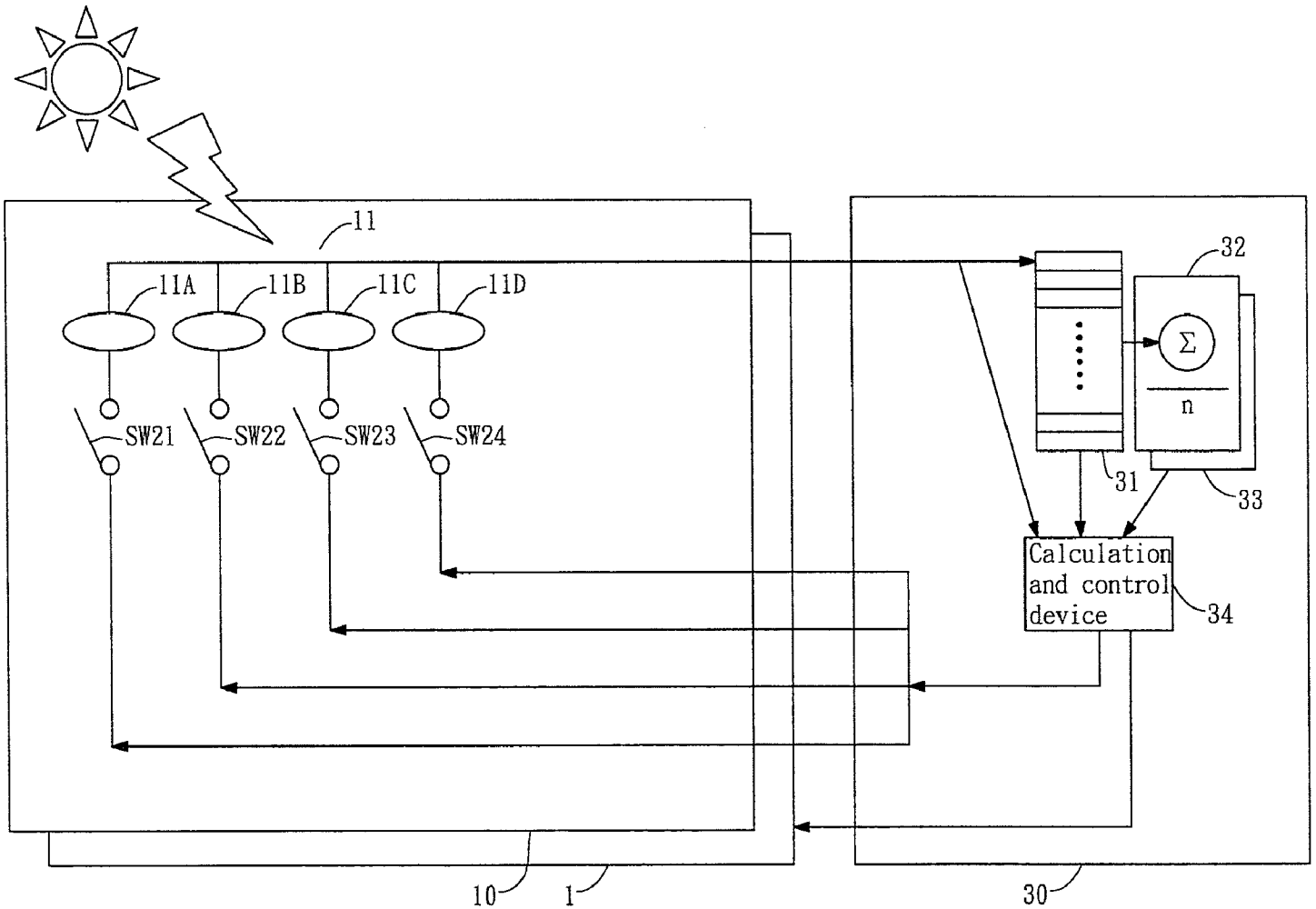
FIG. 6 is a schematic view showing the structure of a display device and the intensity determination steps according to a second embodiment of the present invention.

FIG. 6 is a schematic view showing the structure of a display device and the intensity determination steps according to the second embodiment of the present invention. The only difference between FIGS. 3 and 6 is that the display device illustrated in FIG. 6 adopts four different photosensors 11A~11D instead of the photosensor that switches among four sensitivity ranges and the switch among the switches SW21-SW24 is performed based on the command issued by the calculation and control device 34 thereby to select the sensitivity range.

The remaining steps shown in FIG. 6 are the same as those illustrated in FIGS. 3-5, and hence are not repeatedly illustrated. In this embodiment, a more appropriate photosensor can be selected corresponding to the sensitivity range, thus the intensity of the external light can be more accurately measured and the illuminance of the backlight device can be properly controlled.

In the aforementioned embodiments, the respective proportions of the upper and lower portions that serve as determination bases can be appropriately defined when the sensitivity range is altered. Though either of the upper portion and the lower portion accounts for 25% of the sensitivity ranges in the aforementioned embodiments, an equivalent proportion of 33% or a proportion less than 25% can be adopted as well. In addition, though the middle portion, which means the sensitivity range remains unchanged, is the largest among the three portions, it can be set to be narrower than the upper portion or the lower portion.

The number of data entries used to calculate the average value is not limited to three as described in the aforementioned embodiments. The average value can be calculated using any number of data entries more than two so as to determine the sensitivity range.

In addition, the number of data entries used to calculate the short-time and long-time average values can be appropriately selected as well. As the short-time average value stands for the current distribution tendency and the long-time average value indicates the distribution tendency for a longer period of time, the number of data entries used to calculate the long-time average value can be ten times that of data entries used to calculate the short-time average value when the denominator is the long-time average value, thereby to calculate the average value.

The control device introduced in the embodiments can be assembled through hardware, which is generally a programmable integrated circuit.

Though an LCD apparatus with backlight is described in the embodiments, the present invention is applicable to a variety of display devices with backlight.

What is claimed is:

1. A display device, comprising:

a display panel;

a backlight device disposed under the display panel, the illuminance of said backlight device being adjustable;

a selection and measurement device for light intensity, said selection and measurement device being configured to measure the ambient light intensity of said display panel at a prescribed frequency when light intensity signals of a sensitivity range selected from a plurality of prescribed sensitivity ranges are outputted; and a control device determining whether a number of latest prescribed light intensity signals are all falling within a upper portion, a lower portion or a remaining portion of one of said plurality of prescribed sensitivity ranges, said control device comprising:

a memory device for sequentially memorizing said light intensity signals;

a first average device obtaining a first average value of a first prescribed number of light intensity signals read out from said memory device;

a second average device for obtaining a second average value of a second prescribed number of light intensity signals read out from said memory device, wherein said second prescribed number is larger than said first prescribed number; and a calculation and control device calculating with said selection and measurement device and accordingly controlling the illuminance of said backlight device, wherein said calculating is performed based upon:

the sensitivity range adjacent to said upper portion of said prescribed sensitivity range when said control device determines that all of said first prescribed number of light intensity signals fall within said upper portion and said first average value is greater than said second average value, the sensitivity range adjacent to said lower portion of said sensitivity range when said control device determines that all of said first prescribed number of light intensity signals fall within said lower portion and said first average value is smaller than said second average value, and the sensitivity range when said control device determines that all of said first prescribed number of light intensity signals fall within neither said upper portion nor said lower portion.

2. The display device according to claim 1, wherein said selection and measurement device comprises a plurality of different photoelectric switches and utilizes said prescribed sensitivity ranges outputted therefrom.

3. The display device according to claim 1, wherein said selection and measurement device comprises a plurality of photoelectric switches having respective sensitivity ranges different from each other, and switches and utilizes said prescribed sensitivity range outputted therefrom with said control device.

4. The display device according to claim 1, wherein the proportions of said upper portion, said lower portion and said remaining portion are equal.

5. The display device according to claim 1, wherein said upper and lower portions are narrower than said remaining portion.

6. The display device according to claim 1, wherein said prescribed cycle corresponds to a display frequency of said display device.

7. The display device according to claim 1, wherein said first prescribed number is 2-5 while said second prescribed number is ten times (or above) said first prescribed number.

8. The display device according to claim 1, wherein said memory device is an FIFO (First-in-First-out) memory.

9. A backlight control method for a display device, comprising steps of:

measuring the ambient light intensity of a display panel with a prescribed cycle;

outputting light intensity signals of a sensitivity range selected from a plurality of prescribed sensitivity ranges;

memorizing said light intensity signals sequentially;

determining whether a number of latest light intensity signals are all falling within a upper portion, a lower portion or a remaining portion of one of said plurality of prescribed sensitivity ranges;

obtaining a first average value of a first prescribed number of the memorized light intensity signals;

obtaining a second average value of a second prescribed number of the memorized light intensity signals, wherein said second prescribed number is larger than said first prescribed number; and calculating and accordingly controlling the illuminance of a Illuminance-adjustable backlight device disposed under said display panel, wherein said calculating is performed based upon:

the sensitivity range adjacent to said upper portion of said prescribed sensitivity range when said control device determines that all of said first prescribed number of light intensity signals fall within said upper portion and said first average value is greater than said second average value, the sensitivity range adjacent to said lower portion of said sensitivity range when said control device determines that all of said first prescribed number of light intensity signals fall within said lower portion and said first average value is smaller than said second average value, and the sensitivity range when said control device determines that all of said first prescribed number of light intensity signals fall within neither said upper portion nor said lower portion.

* * * * *